United States Patent [19]

Pecoraro

[11] 4,100,620

[45] Jul. 18, 1978

[54] BODY PROTECTOR

[76] Inventor: Ann Pecoraro, 389 W. Valley Stream Blvd., Valley Stream, N.Y. 11580

[21] Appl. No.: 659,831

[22] Filed: Feb. 20, 1976

[51] Int. Cl.[2] ..... A41D 1/04

[52] U.S. Cl. ..... 2/102; 2/2

[58] Field of Search ..... 2/2, 2.5, 102, 115, 2/120, 108, 93, 19, 22, 23, 24, 97, 297; 128/479

[56] References Cited

U.S. PATENT DOCUMENTS

| | | | |
|---|---|---|---|
| 2,896,631 | 7/1959 | Block | 128/479 |
| 3,116,489 | 1/1964 | Weiss | 2/2 |
| 3,266,069 | 8/1966 | O'Link | 2/108 |
| 3,582,988 | 6/1971 | Armellino | 2/2.2 |
| 3,950,789 | 4/1976 | Konz | 2/93 |

*Primary Examiner*—Doris L. Troutman
*Attorney, Agent, or Firm*—Leonard H. King

[57] ABSTRACT

A vest having a semi-rigid closed cell foamed polyethylene liner which disperses the shock of impact of a ball. Padding provides additional cushioning as a shock absorbant. The vest is light in weight and is provided with crease lines which permit the semi-rigid liner to yield in order to enable the wearer to assume various postures.

7 Claims, 5 Drawing Figures

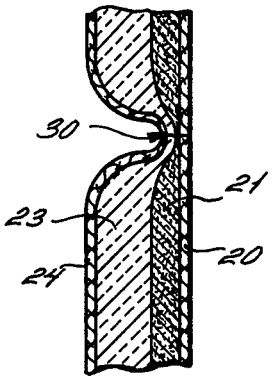
FIG. 3
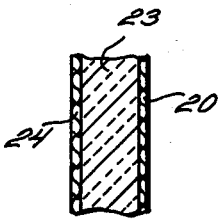
FIG. 4
FIG. 5
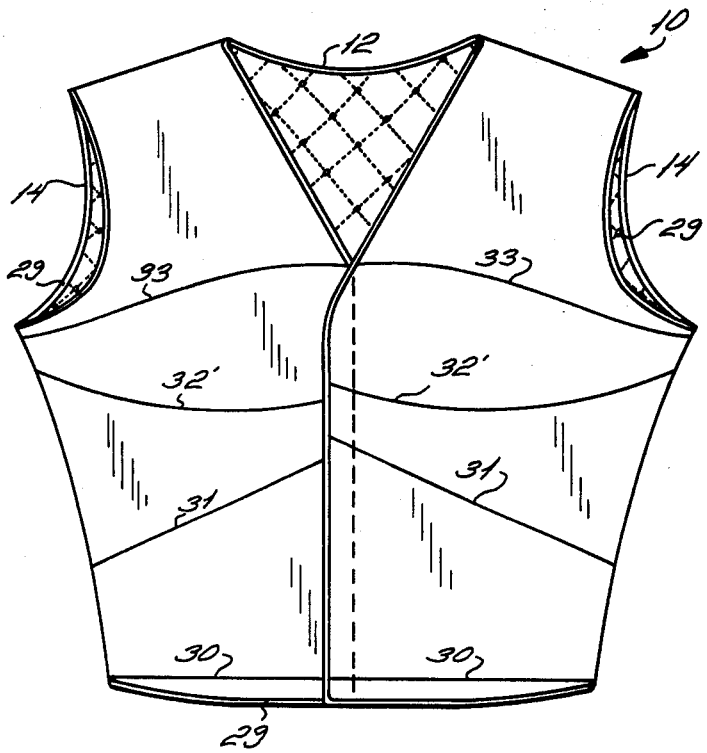

BODY PROTECTOR

FIELD OF THE INVENTION

The present invention relates to improved chest and body protectors and particularly to light-weight protectors suited for use by boys and girls while engaging in sports.

BACKGROUND OF THE INVENTION

Every year many young ball players are struck by pitched balls and seriously, and sometimes fatally, injured.

While protective devices have been worn by certain players, such as baseball catchers, such devices have been unsuitable for batters, pitchers, etc. because they have been generally cumbersome, unwieldly, heavy or interfered with performance.

In order to be useful, the protective device must be light and not interfere with activity.

Further, it must be attractive so as to not discourage the young user from wearing it.

Accordingly, it is an object of the invention to provide a light-weight protective garment for use in sports.

A further object is to provide a non-interfering protective garment.

A different object is to provide a protective garment which can deflect a thrown ball.

A particular object is to provide a semi-rigid vest for sports use which does not inhibit physical movement.

The above-description, as well as further objects, features and advantages of the present invention, will be more fully appreciated by reference to the following detailed description of a presently preferred, but nonetheless illustrative, embodiment in accordance with the present invention when taken in conjunction with the accompanying drawings.

IN THE DRAWINGS:

FIG. 3 is a sectional view taken along line 3—3 of FIG. 4;

FIG. 4 is a sectional view taken along line 4—4 of FIG. 2; and

FIG. 5 is a front elevational view of a girls' model vest.

Figure 1:
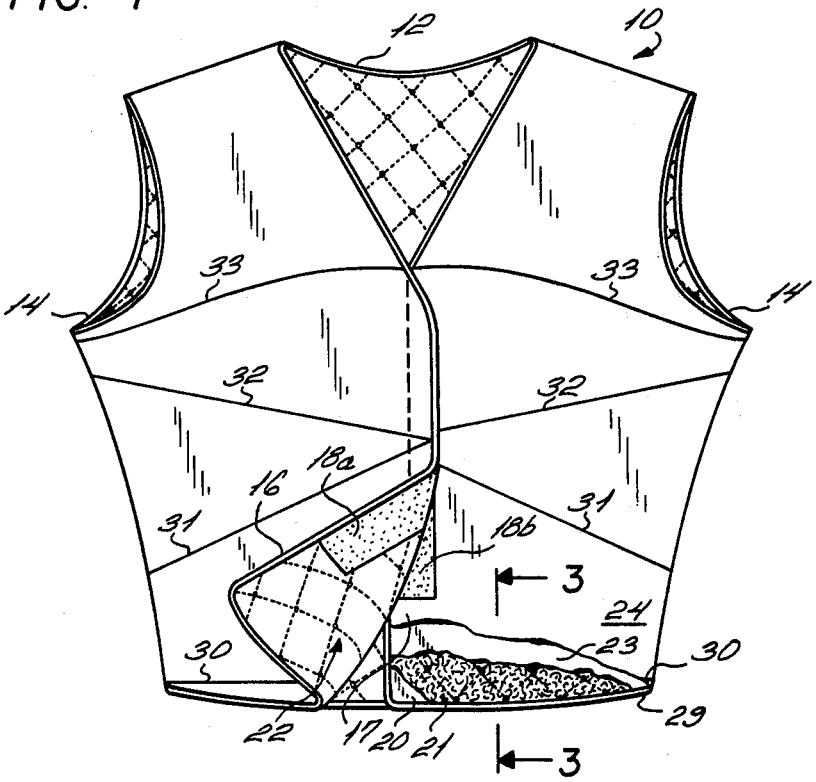
FIG. 1 is a front elevational view of a protective vest, partially broken away to expose various layers.

DESCRIPTION OF THE PREFERRED EMBODIMENT:

As shown in FIG. 1 the garment 10 is in the form of a vest having a neck opening 12, arm openings 14 and overlapping flap 16. The flap 16 is held down to the underneath layer 17 by "VELCRO" fastener **18*a*, 18*b***.

The garment is cut and tailored using conventional techniques. The inner lining 20 may be made of cotton, nylon, polyester cloth or other suitable material. A padding of cotton 21 is then added and preferably locked in place against the back by a quilting stitch 22. The cotton padding presewn to backing 20 is available as a standard item of commerce. A layer of foamed polyethylene 23, having a thickness of from 3/16 inch to 5/16 inch and a density of two pounds per cubic foot is then added and covered with a layer 24 of cotton, nylon or polyester cloth or other suitable cloth. The cloth may be provided in team colors.

Figure 2:
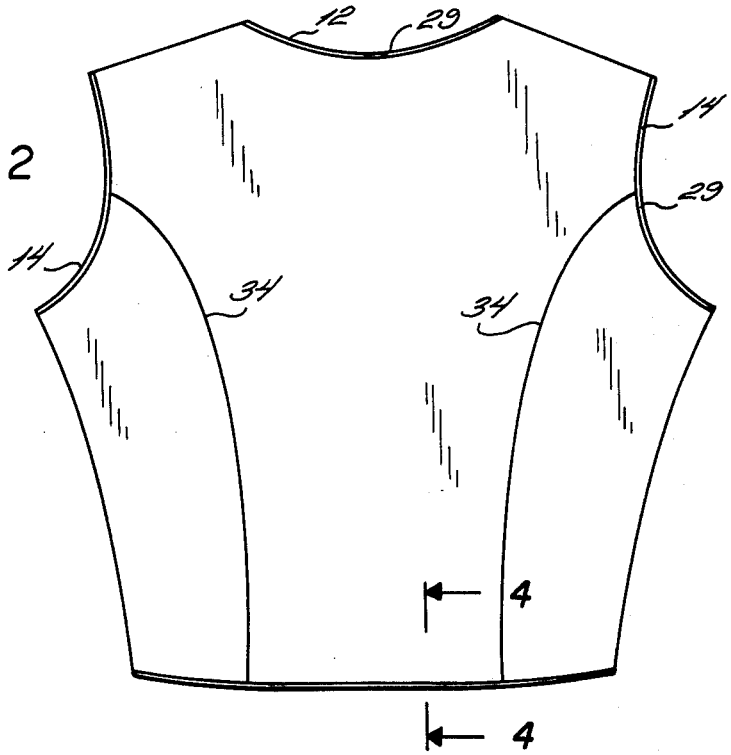
FIG. 2 is a rear elevational view of the vest of FIG. 1.

The foamed polyethylene is then sewn into place by stitches placed along lines 30–33. The stitch compresses the assembly as shown in FIG. 3. This renders the ordinarily stiff assembly to bend along the fold line. The bend along line 30 is important as it permits the user to bend. Stitch lines 31 and 32 are important to batters who have to assume a crouching position and the angular lines 31 and 32 extending from about the midpoint of the chest, one up at an angle of about 20° toward the armpit and the other down at an angle of about 20° toward the hip. Stitch 33 extends from the region just below the Manubrium of Sternum to the armpit to permit free movement of the shoulder. It will be noted that both the left and right side are similar, making it suitable for left or right-handed players. Seams 34 are provided on the back as shown in FIG. 2. A piping or binding 29 of the same color as the shell, or a contrasting color, may be employed.

In FIG. 4 there is shown in cross-section the foamed polyethylene layer 23 sandwiched between covering cloth layers 20 and 24, the cotton padding being eliminated. The padding is provided for reasons of comfort rather than safety and may be omitted.

The garment has been found to be effective against fast-pitched hard baseballs. Under impact the foamed polystyrene acts as a semi-rigid member serving to distribute the stress over a relatively large area, thus shielding the user. The cotton, or other soft padding, cushions the shock.

A modified garment, shown in FIG. 5, is intended for use by female users. For example, the overlap is right to left and stitch line 32' is arcuate to generally follow the female bust line.

The padding 21 may consist of (90%) percent acrylic fibers and (10%) percent polyester fibers. With a nylon shell, such a garment is readily machine washable.

Thus, there has been provided a vest having a semi-rigid closed cell foamed polyethylene liner which disperses the shock of impact of a ball. Padding provides additional cushioning as a shock absorbant. The vest is light in weight and is provided with crease lines which permit the semi-rigid liner to yield in order to enable the wearer to assume various postures.

While described as suited for baseball players, it is to be appreciated that the vest is suited for other sports.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A protective garment for sports use comprising:
   - an outer ply of cloth;
   - an inner ply of cloth;
   - a ply of foamed polyethylene padding between said inner and outer plies of cloth;
   - a ply of fibrous padding between the said ply of foamed polyethylene padding and said inner ply of cloth; and
   - the plies of cloth and padding being permanently stitched together.

2. The garment of claim 1 wherein the ply of fibrous padding and a said inner ply are permanently quilted together.

3. The garment of claim 1 wherein the fibrous padding is formed of synthetic fibers.

4. The garment of claim 1 wherein the said ply of foamed polyethylene has a thickness of between 3/16 inch and 5/16 inch and a density of about two pounds per cubic foot.

5. The garment of claim 1 including a horizontal row of stitching forming a fold line extending through the said ply of polyethylene padding proximate the bottom of the vest.

6. The garment of claim 1 including an arm hole and a fold line for the said ply of foamed polyethylene extending from the region at the bottom of the arm hole at a downwardly extending angle to the middle of the vest front.

7. The garment of claim 1 including a fold line for the said ply of foamed polyethylene extending downard at an angle of about 20° from the middle of the vest front.

* * * * *